US006517676B1

(12) United States Patent
Mathur

(10) Patent No.: US 6,517,676 B1
(45) Date of Patent: Feb. 11, 2003

(54) RECYCLABLE THERMOPLASTIC MOLDABLE NONWOVEN LINER FOR OFFICE PARTITION AND METHOD FOR ITS MANUFACTURE

(75) Inventor: Ashish Mathur, Wilmington, DE (US)

(73) Assignee: Ahlstrom Mount Holly Springs, LLC, Mount Holly Springs, PA (US)

( * ) Notice: Subject to any disclaimer, the term of this patent is extended or adjusted under 35 U.S.C. 154(b) by 0 days.

(21) Appl. No.: 09/478,826

(22) Filed: Jan. 6, 2000

Related U.S. Application Data

(60) Provisional application No. 60/115,218, filed on Jan. 8, 1999.

(51) Int. Cl.[7] ..... D21H 13/24

(52) U.S. Cl. ..... 162/146; 162/149; 162/157.3; 162/164.1; 162/204; 162/207

(58) Field of Search ..... 162/109, 117, 162/129, 135, 136, 146, 148, 149, 157.1, 157.2, 257.3, 206, 207, 158, 164.1; 428/297.4, 299.7, 327, 480, 297.7, 300.4, 301.4, 332; 442/364, 411, 415, 416

(56) References Cited

U.S. PATENT DOCUMENTS

| | | | | | |
|---|---|---|---|---|---|
| 288,726 | A | | 11/1883 | Offermann et al. | 428/107 |
| 3,393,119 | A | | 7/1968 | Dugan | 442/225 |
| 3,554,852 | A | | 1/1971 | Sugarman | 442/281 |
| 3,705,063 | A | | 12/1972 | Stumpf | 156/72 |
| 3,713,936 | A | | 1/1973 | Ramsay | 156/242 |
| 3,755,051 | A | | 8/1973 | Stumpf | 428/89 |
| 4,007,083 | A | * | 2/1977 | Ring et al. | 162/101 |
| 4,048,368 | A | | 9/1977 | Hale et al. | 442/215 |
| 4,188,445 | A | | 2/1980 | Hill | 442/280 |
| 4,242,398 | A | | 12/1980 | Segawa et al. | 428/172 |
| 4,356,226 | A | | 10/1982 | Georlette et al. | 442/268 |
| 4,432,822 | A | | 2/1984 | Adams et al. | 156/148 |
| 4,460,643 | A | | 7/1984 | Stevens et al. | 442/396 |
| 4,710,432 | A | * | 12/1987 | Nishimura et al. | 428/542.8 |
| 4,728,394 | A | | 3/1988 | Shinjou et al. | 162/129 |
| 4,734,321 | A | * | 3/1988 | Radvan et al. | 428/283 |
| 4,882,114 | A | * | 11/1989 | Radvan et al. | 264/129 |
| 5,075,142 | A | | 12/1991 | Zafiroglu | 428/36.1 |
| 5,132,166 | A | | 7/1992 | Adams et al. | 428/212 |
| 5,133,835 | A | * | 7/1992 | Goettmann et al. | 162/146 |
| 5,164,254 | A | | 11/1992 | Todd et al. | 428/172 |
| 5,167,764 | A | | 12/1992 | Nielsen et al. | 162/146 |
| 5,187,005 | A | | 2/1993 | Stahle et al. | 442/208 |
| 5,225,242 | A | | 7/1993 | Frankosky et al. | 427/209 |
| 5,268,222 | A | | 12/1993 | Honeycutt | 442/270 |
| 5,271,997 | A | | 12/1993 | Baigas | 442/281 |
| 5,277,969 | A | | 1/1994 | Borri et al. | 442/225 |
| 5,292,577 | A | | 3/1994 | Van Kerrebrouck et al. | 442/268 |
| 5,393,379 | A | * | 2/1995 | Parrinello | 162/101 |
| 5,403,444 | A | * | 4/1995 | Goettmann et al. | 162/146 |

(List continued on next page.)

*Primary Examiner*—Steven P. Griffin
*Assistant Examiner*—Eric Hug
(74) *Attorney, Agent, or Firm*—Ostrager Chong & Flaherty LLP

(57) ABSTRACT

A rigid thermoformable recyclable nonwoven liner material is formed by a wet process on a papermaking machine. The rigid thermoformable nonwoven liner material is intended to be laminated to a woven fabric and then thermomolded around a wooden panel to form an office partition. The wet-laying process may consist entirely of conventional steps. The fiber furnish includes polyester matrix fibers and co-polyester/polyester bicomponent binder fibers. The web of fibers coming off the papermaking machine is passed through a foam press, which applies a water-based medium having polyvinyl chloride binder dispersed therein. The web is dried, treated again with a water-based medium having polyvinyl chloride binder dispersed therein and then dried again. The final product can be molded in a wide range of temperatures ranging from 225° to 300° F.

19 Claims, 3 Drawing Sheets

U.S. PATENT DOCUMENTS 5,415,738 A * 5/1995 Mehta et al. ..... 162/146
5,492,580 A 2/1996 Frank ..... 156/72
5,508,093 A 4/1996 Mehdorn ..... 428/219
5,554,831 A 9/1996 Matsukawa et al. ..... 181/294
5,677,027 A 10/1997 Masuda et al. ..... 428/96
5,783,039 A * 7/1998 Murayama ..... 162/146
6,261,414 B1 * 7/2001 Kato et al. ..... 162/146
6,267,843 B1 * 7/2001 Helwig et al. ..... 162/145

* cited by examiner

RECYCLABLE THERMOPLASTIC MOLDABLE NONWOVEN LINER FOR OFFICE PARTITION AND METHOD FOR ITS MANUFACTURE

This application claims the benefit of U.S. Provisional Application No. 60/115,218, filed Jan. 8, 1999.

FIELD OF THE INVENTION

This invention generally relates to synthetic nonwoven materials fabricated by wet-laid processes. In particular, the invention relates to a paper-like web made with polyester fibers which is useful as a thermoformable liner material for framed structures, such as an office partition.

BACKGROUND OF THE INVENTION

A typical office partition construction involves laminating several different components together, with each component providing a specific functionality to the structure. Most of such structures use fiberglass mats which have been impregnated with phenolic or other thermosetting saturants to impart the desired rigidity to the structure. Such laminated structures are unnecessarily complicated and are not completely recyclable. There is a need for an improved office partition construction having fewer components.

An improved office partition comprises a rigid frame, e.g., a wooden panel, and a woven fabric which is attached to the wooden panel. There is a need for completely recyclable and environmentally friendly means for attaching the woven fabric to the wooden panel.

SUMMARY OF THE INVENTION

The present invention is a rigid thermoformable recyclable nonwoven liner material which is formed by a wet process on a papermaking machine. The wet-laying process is most suitable for this application as compared to other existing forming technologies due to the resulting uniformity in structure and tight construction. This invention also has the benefit of eliminating the manufacturing costs associated with dry web formation. The rigid thermoformable nonwoven liner material is intended to be laminated to a woven fabric and then thermomolded around a wooden panel to form an office partition. The paper-like construction is most beneficial in order to meet the tackability (i.e., tack-holding) requirement for the substrate.

The wet-laying process may consist entirely of conventional steps. The fiber furnish includes thermoplastic matrix fibers and thermoplastic binder fibers. In accordance with the preferred embodiment, the matrix fibers are made of polyester and the binder fibers are bicomponent fibers having co-polyester sheaths and polyester cores. The use of polyester is advantageous in that polyester is considered to be flame retardant in nature. The bicomponent fibers serve two purposes. First, the low melting point of the co-polyester enables bonding and therefore provides sufficient strength for on-line processing and handling during substrate manufacture. Second, the co-polyester sheath material is moldable at a lower temperature compared to the matrix polyester fibers.

In accordance with one preferred embodiment of the method of manufacturing a nonwoven liner material for use as a thermoformable liner in an office partition, the web of fibers coming off the papermaking machine is passed through a first binder application station, which applies a water-based solution, emulsion or foam having binder dispersed therein to one side of the web. In accordance with the preferred embodiment, the binder consists of polyvinyl chloride. The polyvinyl chloride binder features a curing mechanism which is activated by heat. The curing temperature of polyvinyl chloride is in the range of 225° to 280° F. Curing above 250° F. imparts the wet strength and the rigidity desired for the product. Alternatively, the binder can be polyvinylidene chloride or polyester.

The treated web exits the first binder application station and enters an infrared dryer comprising a plurality of infrared heaters which remove moisture from the web. Additional moisture is removed by passing the web through a first section of dryer cans. The dryer cans are heated to a temperature of about 300° F. Since the polyester sheath of the binder fiber has a melting point in the range of 225° to 240° F., the binder fibers are activated, i.e., the sheaths are melted, as the web passes over the dryer cans. Also the binder, which has a film forming temperature of 150° F. and a curing temperature ranging from 225° to 240° F., is activated.

After drying in the first section of dryer cans, the web passes through a second binder application station, which again applies a water-based solution, emulsion or foam to the web. The water-based solution, emulsion or foam has the same type of binder particles as those applied during the first binder application. The web is then passed through a second section of dryer cans to again remove moisture. The temperature of the dryer cans in the second section is about 300° F. Again the binder fiber sheath material is melted and the binder is activated as the web passes over the dryer cans. Upon cooling of the web, the binder fiber sheath material is fused to neighboring matrix fibers. The web is then wound on a winder roll. Optionally, the dried web is calendered using unheated calender rolls prior to winding.

The final product is a 100% recyclable, 100% thermoplastic nonwoven liner material. Being 100% thermoplastic in nature, the final product can be molded in a wide range of temperatures ranging from 225° to 300° F.

DETAILED DESCRIPTION OF THE PREFERRED EMBODIMENTS

In accordance with a first preferred embodiment of the invention, the fiber furnish comprises 20 wt. % of 2.0 denier×5 mm Type N-720H bicomponent (co-polyester sheath/polyester core) binder fiber supplied by Kuraray (sheath melting temp. 225° F.); 20 wt. % 1.5-denier×0.5" Type 103 polyester staple fibers supplied by Hoechst/Celanese (melting temp. 480° F.); 40 wt. % 6.0-denier×1.0" Type 103 polyester staple fibers supplied by Hoechst/Celanese (melting temp. 480° F.); and 20 wt. % 15.0-denier×1.5" Type 103 polyester staple fibers supplied by Hoechst/Celanese (melting temp. 480° F.). All of the foregoing fiber types are sized by the respective manufacturer. It will be readily appreciated, however, that other polyester staple fibers could be used in place of the Hoechst/Celanese fibers specified above. Also the fiber deniers and lengths can be varied from those set forth above. Strength and porosity characteristics are imparted to the composite by the combination of polyester fibers employed in the invention. In particular, the strength of the composite can be improved by varying the polyester fiber content in accordance with the following functional relations: (a) as the polyester denier increases at constant length and amount, the porosity, bulk and stiffness of the composite increase and the amount of fiber entanglement decreases; and (b) as the polyester length increases at constant denier and amount, the tensile and tear strengths in the MD and CD directions and the Mullen burst strength increase and the stiffness decreases.

In accordance with other preferred embodiments, the amount of 2.0 denier×5 mm Type N-720H bicomponent binder fiber can be varied from about 0 to about 40 wt. %; the amount of 1.5 denier×0.5" Type 103 polyester staple fibers can be varied from about 10 to about 30 wt. %; the amount of 6.0 denier×1.0" Type 103 polyester staple fibers can be varied from about 20 to about 60 wt. %; and the amount of 15.0 denier×1.5" Type 103 polyester staple fibers can be varied from 0 to about 60 wt. %.

Figure 1:
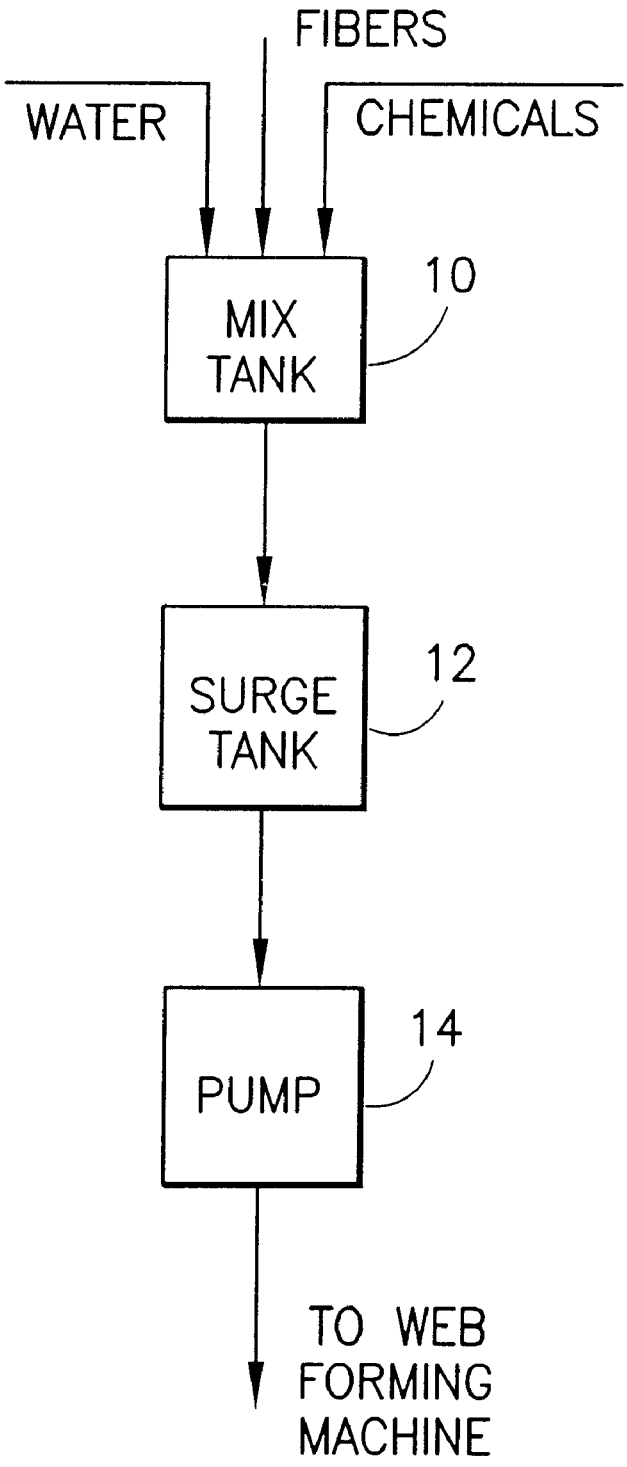
FIG. 1 is a diagrammatic view of apparatus for preparation of stock or furnish for manufacture of the composite material of the invention.

Using a fiber furnish of the type described above, a high-strength nonwoven material is formed by a wet-laying process on a conventional papermaking machine. FIG. 1 illustrates an apparatus for preparation of stock or furnish for manufacture of the composite material. The wet-laid forming process begins with stock preparation to make an evenly dispersed mixture of the polymeric fibers. The polymeric fibers are opened (separated) and dispersed in a mixing tank 10. The mixing tank 10 is equipped with an agitator which provides the shear energy required to effect good fiber separation and dispersion throughout the mix volume. Water, chemicals and fibers are added to the mixing tank 10 in controlled amounts to obtain a desired stock consistency. From an operational point of view, thicker stock consistencies are desirable to minimize preparation time and save on chemical usage. The consistency level should be chosen so that the forming process can be operated at its optimal speed for a particular grade of fabric.

Figure 2:
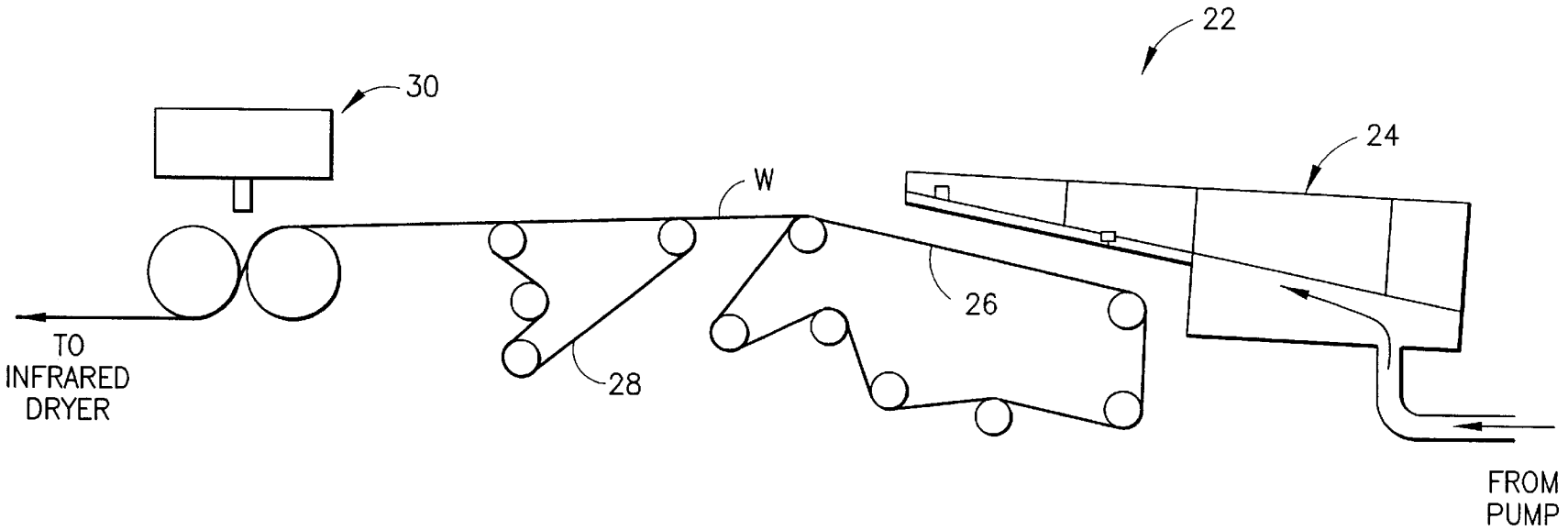
FIG. 2 is a diagrammatic view of apparatus for formation of a web by the wet-laying process and a first application of a binder.

With the completion of the stock preparation, the thick stock furnish is transferred to a holding or surge tank 12, so that the next batch of stock can be prepared. The surge tank 12 is equipped with an agitator to keep the thick stock uniformly mixed. The surge tank 12 meters stock into a web forming machine via a pump 14. The web forming machine 22 (shown in FIG. 2) may be of the type known as a Fourdrinier or a Rotoformer. The stock is fed to a head box 24 in the forming machine 22 where it is diluted with water to a lower consistency and brought to a forming zone of an endless wire (mesh) 26 moving in a machine direction. In the forming zone, water from the diluted stock is applied to the wire 26 is drawn through the wire, leaving behind the fiber web or sheet. The drained water is then recirculated through a primary water circuit. The temperature to which the polymeric fibers are exposed on the wet-laying machine 22 lies in the range of 325–365° F. During the wet-laying process, the co-polyester sheath materials of the N-720H bicomponent binder fibers (which sheath material has a melting point of 225° F.) melts and then fuses upon cooling to lend strength to the web during further processing.

After formation, the web W is transported to a first binder application station 30 by a transfer wire 28. The first binder application station may comprise any conventional means for applying a water-based solution, emulsion or foam having binder dispersed therein, e.g., a saturator or a foam press.

In accordance with preferred embodiments of the invention, the binder is polyvinyl chloride. A preferred water-based emulsion of polyvinyl chloride is Vycar 460×95 (50% solids), which is commercially available from B.F. Goodrich Chemical Company. The Vycar 460×95 polyvinyl chloride binder has a curing temperature of 250–260° F. TN-810 or equivalent polyvinyl chloride binder can be used. The TN-810 polyvinyl chloride binder is commercially available from B.F. Goodrich Chemical Company and has a glass transition temperature greater than 130° F. The TN-810 is moldable in a temperature range of 225° to 300° F. Alternatively, the binder can be polyvinylidene chloride or polyester having a melting point lower than the melting point of the polyester matrix fibers.

Figure 3:
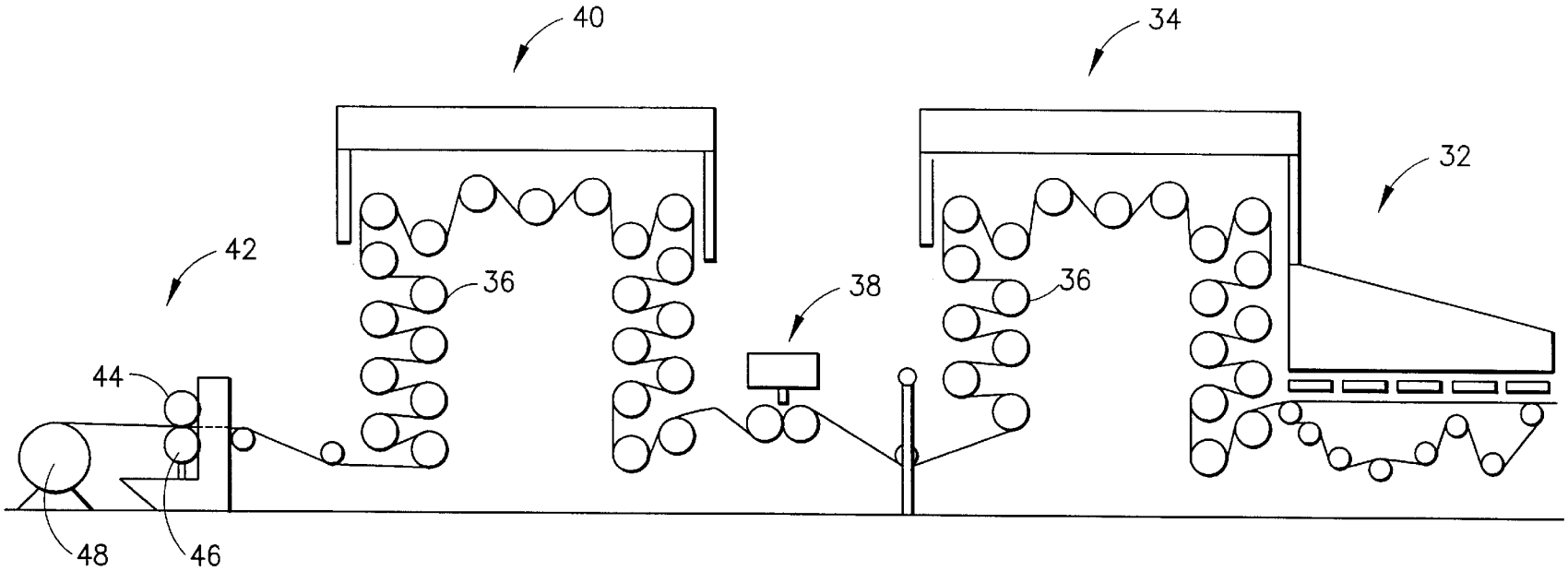
FIG. 3 is a diagrammatic view of apparatus for drying the web and a second application of binder in accordance with the preferred embodiment of the invention.

Referring to FIG. 3, the foam-treated web exits the first binder application station 30 and enters an infrared dryer 32 comprising a plurality of infrared heaters which remove moisture from the web. Then the web is passed through a dryer section 34 comprising a multiplicity of dryer cans 54, where additional moisture is removed. The dryer cans are heated to a temperature of about 300° F. Since the polyester sheath of the binder fiber has a melting point in the range of 225° to 240° F., the binder fibers are activated, i.e., the sheaths are melted, as the web passes over the dryer cans. Also the binder, which cures at a temperature of 225° to 280° F., are activated. After drying in the first section of dryer cans, the web passes through a second binder application station 38, which applies a water-based solution, emulsion or foam of binder to the web. The same binder is applied by the first and second binder application stations.

The web W is then passed through a second section 40 of dryer cans 36 to again remove moisture following the second binder application. The temperature of the dryer cans in the second section is about 300° F. Again the co-polyester binder fiber sheath material is melted and the polyvinyl chloride binder is activated as the web passes over the dryer cans. Upon cooling of the web, the binder bonds to neighboring matrix fibers. The web is then wound up on a reel 48 for further processing. Optionally, the dried web is calendered, prior to winding, in a calendering section 42 using unheated calender rolls 44 and 46.

The final product is a 100% recyclable, 100% thermoplastic nonwoven liner material. Being 100% thermoplastic in nature, the final product can be molded in a wide range of temperatures ranging from 225° to 300° F. The amount of polyvinyl chloride binder in the final product can be in the range of 25 to 40 wt. % of the total weight of the fibers in the nonwoven web. The first preferred embodiment (described above) has 40 wt. % binder add-on. In this case, with the base furnish weighing 4 oz./yd$^2$, the final weight is around 5.6 oz./yd$^2$. When samples of the first preferred embodiment were manufactured, the samples had an average stiffness in the machine direction of 2,308.5 mg.

The foregoing preferred embodiments have been described for the purpose of illustration only and are not intended to limit the scope of the claims hereinafter. Variations and modifications of the composition and method of manufacture may be devised which are nevertheless within the scope and spirit of the claims appended hereto. For example, the deniers of the various polyester matrix fibers can be varied depending on the molding conditions to be employed. In other words, the invention does not require the specific combination of deniers used in the preferred embodiments described above. Also a lower-melting-point polyester fiber, e.g., made of undrawn or amorphous polyester, can be used as the binder fiber, instead of polyester/copolyester bicomponent fiber, in a proportion from 0–40 wt. % of the total fiber furnish. In addition, bicomponent fibers having geometries other than the sheath/core geometry can be utilized. Depending on the degree of rigidity desired, a small amount of cross-linking agent (up to 10 wt. % of the binder) may be added to the polyester binder. If very high rigidity is desired, a B-stageable formaldehyde-free binder, such as HF-O5 supplied by Rohm & Haas Company, could be used. Other variations in web composition will be apparent to persons skilled in the art.

What is claimed is:

1. A method of manufacturing a moldable nonwoven web comprising the following steps:

forming a fiber furnish by mixing at least 60 wt. % of polymeric matrix fibers having melting temperatures above a predetermined temperature and up to 40 wt. % of polymeric binder fibers comprising a first binder material having a melting temperature less than said predetermined temperature;

forming a wet-laid web from said furnish by a conventional papermaking technique;

applying a water-based medium to said wet-laid web, said water-based medium comprising a second binder material having a curing temperature less than said predetermined temperature;

applying heat sufficient to melt said first binder material and activate said second binder material but not melt said matrix fibers;

applying a second water-based medium to said wet-laid web, the second water-based medium being the same as the water-based medium;

applying heat to the web containing the second water-based medium sufficient to melt said first binder material and activate said second binder material but not melt said matrix fibers; and allowing said first and second binder materials to cool until said polymeric matrix fibers are bonded together, wherein said first and second binder materials are selected such that said nonwoven web is moldable in a temperature range from 225° to 300° F.

2. The method as defined in claim 1, further comprising the step of calendering said web between unheated calender rolls.

3. The method as defined in claim 1, wherein said polymeric matrix fibers are made of polyester.

4. The method as defined in claim 3, wherein said first binder material is selected from the group consisting of undrawn polyester, amorphous polyester and co-polyester.

5. The method as defined in claim 4, wherein said binder fibers comprise co-polyester/polyester bicomponent fibers.

6. The method as defined in claim 3, wherein said polyester matrix fibers comprise first and second fractions having deniers of 1.5 and 6 dpf respectively, said first fraction of polyester matrix fibers constituting 10 to 30 wt. % of said furnish, and said second fraction of polyester matrix fibers constituting 20 to 60 wt. % of said furnish.

7. The method as defined in claim 6, wherein said polyester matrix fibers further comprise a third fraction having a denier 15 dpf, said third fraction of polyester matrix fibers constituting up to 60 wt. % of said furnish.

8. The method as defined in claim 1, wherein said polymeric binder fibers have a denier of 2.0 dpf.

9. The method as defined in claim 1, wherein the wet-laid web is formed in a temperature range from 325° F. to 365° F. such that the first binder material melts and upon cooling fuses to the polymeric matrix fibers to lend strength to the web during further processing.

10. A method of manufacturing a moldable nonwoven web comprising the following steps:

forming a fiber furnish by mixing at least 60 wt. % of polyester matrix fibers having melting temperatures above a predetermined temperature and up to 40 wt. % of polymeric binder fibers comprising a first binder material having a melting temperature less than said predetermined temperature, the first binder material being selected from the group consisting of undrawn polyester, amorphous polyester and co-polyester;

forming a wet-laid web from said furnish by a conventional papermaking technique;

applying a water-based medium to said wet-laid web, said water-based medium comprising a second binder material having a curing temperature less than said predetermined temperature, wherein said second binder material is selected from the group consisting of polyvinyl chloride and polyvinylidene chloride;

applying heat sufficient to melt said first binder material and activate said second binder material but not melt said matrix fibers; and allowing said first and second binder materials to cool until said polymeric matrix fibers are bonded together, wherein said first and second binder materials are selected such that said nonwoven web is moldable in a temperature range from 225° to 300° F.

11. The method as defined in claim 10, further comprising the step of calendering said web between unheated calender rolls.

12. The method as defined in claim 10, wherein said binder fibers comprise co-polyester/polyester bicomponent fibers.

13. The method as defined in claim 10, wherein said polyester matrix fibers comprise first and second fractions haying deniers of 1.5 and 6 dpf respectively, said first fraction of polyester matrix fibers constituting 10 to 30 wt. % of said furnish, and said second fraction of polyester matrix fibers constituting 20 to 60 wt. % of said furnish.

14. The method as defined in claim 13, wherein said polyester matrix fibers further comprise a third fraction having a denier of 15 dpf, said third fraction of polyester matrix fibers constituting up to 60 wt. % of said furnish.

15. The method as defined in claim 10, wherein said polymeric binder fibers have a denier of 2.0 dpf.

16. The method as defined in claim 10, wherein the wet-laid web is formed in a temperature range from 325° F. to 365° F. such that the first binder material melts and upon cooling fuses to the polymeric matrix fibers to lend strength to the web during further processing.

17. The method as defined in claim 10, further comprising the steps of applying a second water-based medium to said wet-laid web, the second water-based medium being the same as the water-based medium, and applying heat to the web containing the second water-based medium sufficient to melt said first binder material and activate said second binder material but not melt said matrix fibers.

18. A method of manufacturing a moldable nonwoven web comprising the following steps:

forming a fiber furnish by mixing at least 60 wt. % of polyester matrix fibers having melting temperatures above a predetermined temperature and up to 40 wt. % of polymeric binder fibers comprising a first binder material having a melting temperature less than said predetermined temperature, the binder fibers comprising co-polyester/polyester bicomponent fibers, forming a wet-laid web from said furnish by a conventional papermaking technique;

applying a water-based medium to said wet-laid web, said water-based medium comprising a second binder material having a curing temperature less than said predetermined temperature, wherein said second binder material is selected from the group consisting of polyvinyl chloride and polyvinylidene chloride;

applying heat sufficient to melt said first binder material and activate said second binder material but not melt said matrix fibers; and allowing said first and second binder materials to cool until said polymeric matrix fibers are bonded together, wherein said first and second binder materials are selected such that said nonwoven web is moldable in a temperature range from 225° to 300° F.

19. The method as defined in claim 18, wherein said first binder material is selected from the group consisting of undrawn polyester, amorphous polyester and co-polyester.

* * * * *